US007070519B2

(12) United States Patent
Bellagamba

(10) Patent No.: US 7,070,519 B2
(45) Date of Patent: Jul. 4, 2006

(54) DIVOT TOOL

(76) Inventor: Miro D. Bellagamba, 10120 Cove Lake Dr., Orlando, FL (US) 32836

( * ) Notice: Subject to any disclaimer, the term of this patent is extended or adjusted under 35 U.S.C. 154(b) by 0 days.

(21) Appl. No.: 10/944,642

(22) Filed: Sep. 17, 2004

(65) Prior Publication Data

US 2006/0063614 A1 Mar. 23, 2006

(51) Int. Cl.
*A63B 57/00* (2006.01)

(52) U.S. Cl. ..... 473/408; 473/406

(58) Field of Classification Search ..... 473/406, 473/408; D21/793, 794
See application file for complete search history.

(56) References Cited

U.S. PATENT DOCUMENTS 4,974,842 A * 12/1990 Widman ..... 473/406
5,393,052 A 2/1995 Kennedy
5,529,299 A 6/1996 Bellagamba
5,769,740 A * 6/1998 Colangelo ..... 473/408
D480,444 S * 10/2003 Marchessault et al. ..... D21/794
2004/0248674 A1* 12/2004 Bauley et al. ..... 473/406

* cited by examiner

*Primary Examiner*—Steven Wong
(74) *Attorney, Agent, or Firm*—James H. Beusse; Beusse Wolter Sanks Mora & Maire, P.A.

(57) ABSTRACT

A golf accessory apparatus having a divot tool and a removable ball marker includes an elongate body having a pair of prongs on one end forming a divot tool. A ball marker support is incorporated into the body and has a window for viewing a face of the marker. The marker is coin-shaped having an outer circumferential raised ridge on each side for forming a pair of recessed surfaces for receiving a printed image. The marker is inserted thorough edge openings on the tool body so as to display one of the printed images in the window. Protuberances are formed in the edge openings to releasably restrain the ball marker without scratching of the printed images on the marker during insertion and removal.

9 Claims, 1 Drawing Sheet

DIVOT TOOL

BACKGROUND OF THE INVENTION

The present invention relates to a golf accessory and especially to a golf accessory having a divot tool with a removable ball marker supported on the accessory.

In playing the game of golf, a golfer frequently carries a divot tool and, nearly always, carries a golf ball marker. The golfer is allowed to lift the golf ball from the surface of a putting green for cleaning of the ball or to keep it from being a distraction or obstruction to other golfers. A lifted ball must, however, be marked to assure that when it is replaced it will be returned to the same spot from which it was lifted. Not only do the rules of golf permit such ball removal, it is the common practice and courtesy for the golfer to remove and mark the ball and replace it when it becomes his turn to putt. A ball marker must, however, be placed immediately behind the ball unless the mark is placed so that it would interfere with the play, stance or stroke of another golfer. It should then be placed one or more putter lengths to one side. As a result of this common practice, many golfers carry a ball marker in their pocket and some simply employ a coin for this purpose. A great variety of specialized ball markers have been suggested and used. A common ball marker being used is a disk about the size of a dime with a peg or prong extending axially from the planar surfaces of the disk shaped body. When using a ball marker of the usual type, a golfer laterally moves a marker to a position approximate and at least partially under the ball to insure that he does not violate the provisions of the rules relating to placing the marker immediately behind the ball. When in this position, a golfer then presses down on the ball marker to cause a peg to penetrate the surface of the putting green and thereby possibly locate the marker. This same basic marker locating technique is employed when a coin is used and, even though the coin does not have an axial peg, most golfers will press the coin down into the grass to make sure it is lying flat and that it will not be moved by the grass or present an obstruction should another golfer's ball pass over the marker when it is being putted. A golf ball marker can be seen in my prior U.S. Pat. No. 5,356,133 dated Oct. 18, 1994 and a divot tool with marker can be seen in my U.S. Pat. No. 5,529,299 dated Jun. 25, 1996.

The present invention provides a simple golf accessory which can be carried in the pocket of a golfer or in the golf bag and which provides a divot tool having a pair of prongs for insertion in the turf and which has a marker which is removably carried behind a window where the marker is visible and where a design or logo may be placed for display through the window.

BRIEF DESCRIPTION OF THE DRAWINGS

Various objects, features, and advantages of the present invention will be apparent from the written description and the drawings in which.

DESCRIPTION OF THE PREFERRED EMBODIMENT

Figure 4:
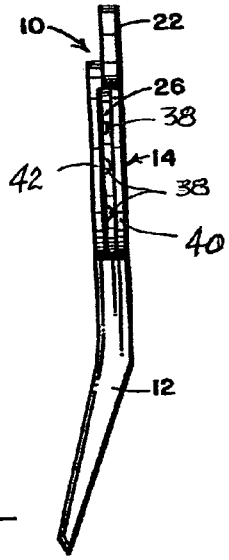
FIG. 4 is a side elevation of the golf accessory of FIGS. 1 and 2.
Figure 3:
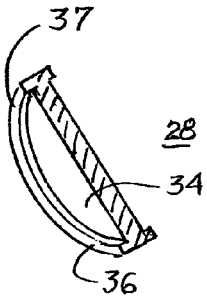
FIG. 3 is a cross-section of the ball marker of FIG. 3.

Referring to the drawings, FIGS. 1–4, a golf accessory 10 has a pair of prongs 12 and 13 on one end of the accessory body 14. The prongs 12 and 13 are angled forward from the rest of the body 14, as can be more clearly seen in FIG. 4. A preferred angle might be approximately 30 degrees and this allows the prongs 12 and 13 to be slid under a ball mark indenture (not shown, but caused by a golf ball striking a golf green from a distance) so that the depression can be repaired to a normal flat surface. The golf accessory 10 has edge slots 26 on each opposite sides of and out of an enlarged portion 27 of the body 14 that allows a ball marker 28 to be slid into the edge slots 26 from either side of body 14 and to be supported behind a front window 30 when inserted. The front window 30 is a cutout from the front face 31 of the enlarged portion 27 of the body 14. Thus, sliding the ball marker 28 into the side opening or slot 26 positions it so that a design 32 on the face or surface 34 of the ball marker 28 is positioned for viewing through the window 30. This advantageously allows for promotional material to be placed for viewing in the window, which material could include a golf clubs' logo and name or, alternatively, advertising material for a corporation. The back of the ball marker 28, as shown in FIG. 4, can have a ball marking arrow thereon, other indicia as desired or other advertising material. The body 14 of the present golf accessory may be made of any material desired but one preferred material would be a plastic, such as a polycarbonate polymer, and the ball marker 28 might be made of a metal, such as brass having an enamel coating thereon. In the form as shown in the cross-sectional view of FIG. 3, the marker 28 is formed with a raised outer circumferential ridge 36 on at least one surface 34 but preferably on both surfaces. The advertising material or other indicia on the surface 34 can be etched on the surface, or can be a decal that is adhesively bonded to the surface or in any other form provided that the thickness of the advertising material is selected to be less than the height of the ridge 36 so that the advertising material is recessed below a top edge 37 of the ridge. As will become apparent, the recessing of the advertising material protects the material from damage during insertion and removal of the marker 28 from the golf accessory.

Figure 1:
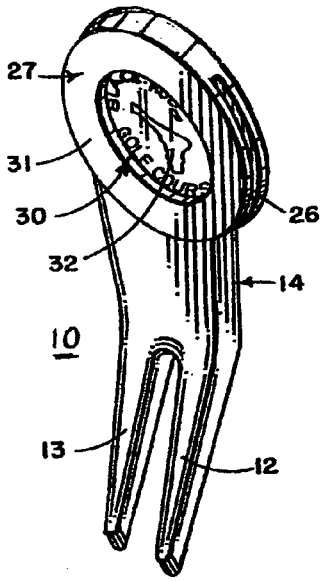
FIG. 1 s a perspective view of the golf accessory in accordance with the present invention having a ball marker therein.
Figure 2:
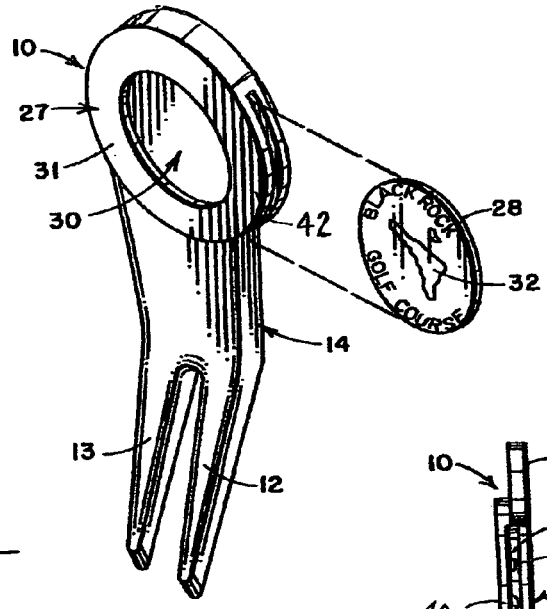
FIG. 2 is a perspective view of the golf accessory of FIG. 1 having the ball marker removed therefrom.

Referring to FIG. 4, the body 14 in this embodiment is preferably formed with edge openings 26 on each side of the window 30 so that the marker 28 can be inserted into the body 14 from either side thereof. The marker 28 is retained in the body 14 by at least one protuberance 38 protruding transversely of each opening 26. The protuberance 38 may be any form of element protruding into the openings but is preferably merely a rounded nodule that can be integrally molded into the body 14. Each opening 26 is defined by a back portion 40 of the body 14 and an arcuate, elastic member 42 from which each protuberance 38 depends. The member 42, also shown in FIG. 2, is typically formed integrally with the body 14 and is therefore formed of the same polymer as body 14. The elasticity of the member 42 is due in at least part to the relatively thin and narrow dimension of the member at the opening. In a preferred embodiment, there are three protuberances 38 at each opening 26.

The marker 28 is sized to fit snugly through each opening 26 with the edges 37 of the raised ridges 36 engaging both the back portion 40 and the protuberances 38 on the inner surface of member 42. When the marker 28 is pressed into either opening 26, edge 37 of the marker ridge 36 engages the rounded protuberances 38 which act as wedges to drive the member 42 away from the marker and allows the marker to be slid through the opening. Since the height of the protuberances 38 and height of the ridges 36 are selected to minimize contact between the protuberances and any decal or other indicia on the face of the marker, such decals or indicia are not scraped or scratched by the protuberances during either insertion or removal of the marker from the accessory body 14. The elasticity of the member 42 allows the member to undergo the in and out movement necessary to insert and remove the marker from the accessory and to return to its normal position when the marker is fully inserted or fully removed from the body 14.

Figure 5:
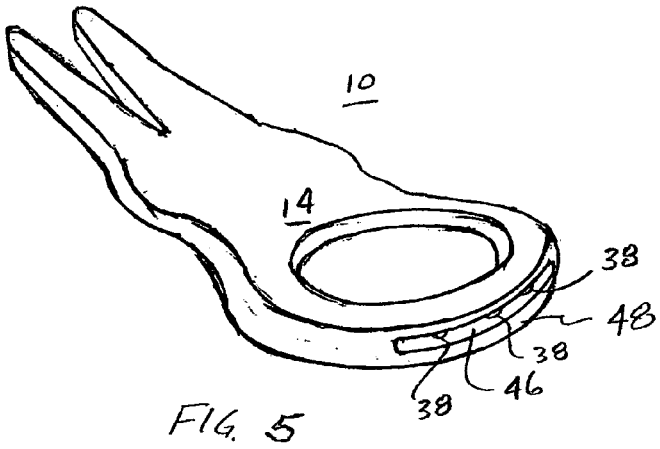
FIG. 5 is a perspective view of another embodiment of the golf accessory of FIG. 1.

Another embodiment of the invention is shown in FIG. 5 in which there is provided a slot 46 along the top edge 48 of the body portion 14. This embodiment allows the marker 28 to be removed by sliding upward from the body 14 and is believed to be more ergonomically comfortable for the user since the normal movement of a user's thumb is outward in a line along the direction of the forearm. Note the three visible protuberances 38 within slot 46.

It should be clear at this time that a golf accessory has been provided which has a divot tool formed on one end thereof and a removable ball marker supported thereon within the body of the golf accessory and which is positioned to display the ball marker face which might have a design thereon. Accordingly, the present invention is to be considered illustrative rather than restrictive.

What is claimed is:

1. A golf accessory apparatus having a divot tool and a removable ball marker comprising:

an elongate body having at least a pair of prongs on one end thereof forming a divot tool, said body having front and rear sides and a plurality of edges, a ball marker support incorporated into said body including a first and a second edge opening and a window in said front side for removably sliding a ball marker of predetermined shape through either of said first and second edge openings by engaging a surface of the ball marker via the window;

a coin-shaped ball marker having an outer circumferential raised ridge on each side thereof for forming a pair of recessed surfaces for receiving a printed image on each side of the marker, the marker being sized to fit into said edge openings so as to display at least one of the printed images in the window when the marker is placed into the body of the apparatus; and means for releasably restraining the ball marker in the body of the apparatus, said restraining means being adapted to minimize scratching of the printed images on the marker.

2. The golf accessory apparatus of claim 1 wherein the marker restraining means comprises at least one protuberance formed in each of said first and second edge openings.

3. The golf accessory apparatus of claim 2 wherein said at least one protuberance extends into said edge openings perpendicular to a plane of said marker when said marker is inserted into said body.

4. The golf accessory apparatus of claim 2 wherein said at least one protuberance extends into said edge openings a distance sufficient to engage said raised ridge of said marker but less than a distance sufficient to engage said recessed surfaces.

5. The golf accessory apparatus of claim 4 wherein each said edge opening is defined by the rear side of said body and a flexible member coincident with said front side of said body and extending across said edge opening.

6. The golf accessory apparatus of claim 5 wherein said protuberances extend into said edge opening from said flexible member.

7. A golf accessory apparatus having a divot tool and a removeable ball marker comprising:

a coin-shaped ball marker;

an elongate body having at least a pair of prongs on one end thereof forming a divot tool, said body having front and rear sides and a plurality of edges, a ball marker support incorporated into said body including at least one edge opening and a window in said front side for viewing the marker and for removably sliding the ball marker through said at least one edge opening by engaging a surface of the ball marker via the window, said edge opening being defined by a back portion of said body and a relatively thin, arcuate segment coincident with a front portion of said body, said protuberances depending from said arcuate segment; and a plurality of protuberances extending into said edge opening for releasably restraining the ball marker in the body of the apparatus.

8. The golf accessory of claim 7 wherein said edge opening is formed along an upper edge of said body opposite said pair of prongs.

9. The golf accessory of claim 7 wherein said body is formed with a pair of edge openings on opposite lateral edges of said body.

* * * * *